United States Patent [19]

Ferstenberg

[11] 4,329,890

[45] May 18, 1982

[54] DEVICE FOR SETTING PRECIOUS STONES

[76] Inventor: Frederik Ferstenberg, 8, Baillet-Latourlei, 2130 Brasschaat, Belgium

[21] Appl. No.: 160,624

[22] Filed: Jun. 18, 1980

[30] Foreign Application Priority Data

Jun. 21, 1979 [BE] Belgium ..... 57892
Jun. 13, 1980 [BE] Belgium ..... 58602

[51] Int. Cl.[3] ..... B23P 5/00
[52] U.S. Cl. ..... 81/7; 29/10
[58] Field of Search ..... 81/7; 29/251, 231, 10

[56] References Cited

U.S. PATENT DOCUMENTS 685,338 10/1901 Leusch ..... 29/231
1,045,299 11/1912 Krimmling ..... 81/7
1,442,986 1/1923 Toy ..... 81/7
2,140,465 12/1938 Bangs ..... 81/7 X

*Primary Examiner*—Jimmy C. Peters
*Attorney, Agent, or Firm*—Bacon & Thomas

[57] ABSTRACT

Device for setting precious stones in bezels with claws, mounted on rings or similar, characterized by the combination of: a receptacle; a support for a ring or similar at least partially engageable into said receptacle; a device for maintaining a stone placed into the bezel of ring or similar, said support being engaged into the receptacle and a setting device, all aforesaid devices and support being functionally integral with one another at least when the device is in setting position.

13 Claims, 13 Drawing Figures

DEVICE FOR SETTING PRECIOUS STONES

The present invention relates to a device for setting precious stones, mounted as solitaires, in the bezels of rings and similar articles.

In the fancy jewellery trade, semi-automatic and automatic setting devices are used since many years. Such is not the case for the mounting of expensive stones (for instance diamonds from 0.5 crt upwards), for which the craftsman's intervention is still indispensable.

Moreover, the sales of uncut and unmounted stones, considered as refuge values, is developing well. The buyers of such stones often wish afterwards to have them mounted. In this case they are often compelled to consign their stones to the care of unknown persons, which they are repugnant to, fearing that they will be given back stones of lesser value.

The object of the invention is to make available a simple device allowing a private individual to safely carry out the setting himself, or allowing a jeweller to perform this work in the presence of his customer.

According to the invention, this object is attained by a device comprising, in combination: a receptacle means; a support for a ring or similar at least partially engageable into said receptacle means; a means for maintaining a stone placed into the bezel of said ring or similar, said support being engaged into said receptacle means and a setting means, all aforesaid means and support being functionnally integral with one another at least when the device is in setting position.

For the sake of clearness, embodiments of the invention are described hereinafter as non limiting examples, reference being made to the attached drawings, in which.

Figure 9:
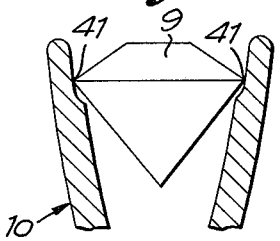
Figure 10:
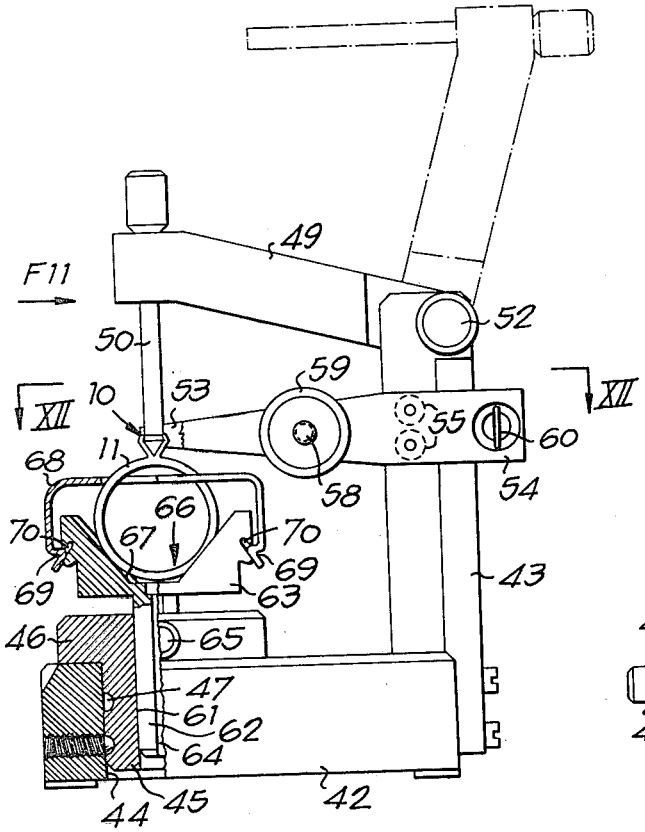
Figure 11:
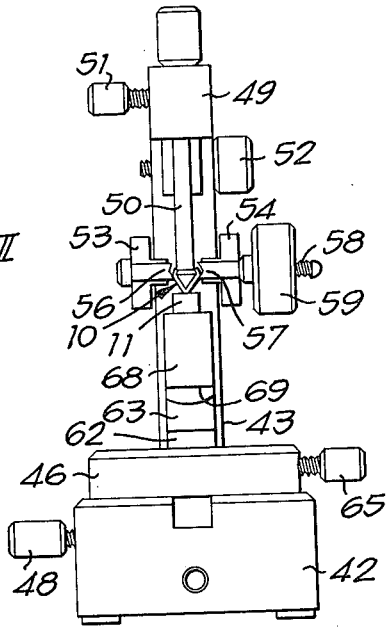
Figure 12:
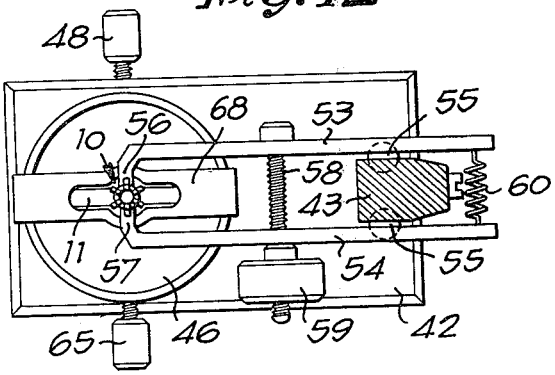

FIG. 9 schematically shows a preferred type of claws;

FIG. 10 is a view in elevation with partial section of the now preferred embodiment of the invention;

FIG. 11 is a view according to arrow F11 of FIG. 10;

FIG. 12 is a section according to line XII—XII of FIG. 10; and

Figure 13:
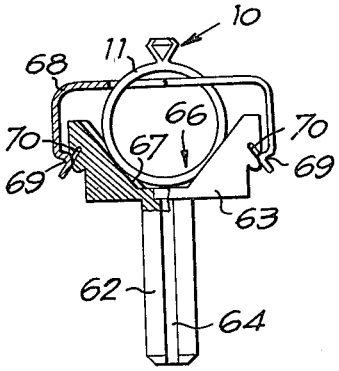

FIG. 13 shows on an enlarged scale, the ring supporting body visible in FIGS. 10–12.

Figures 1, 2, 3:
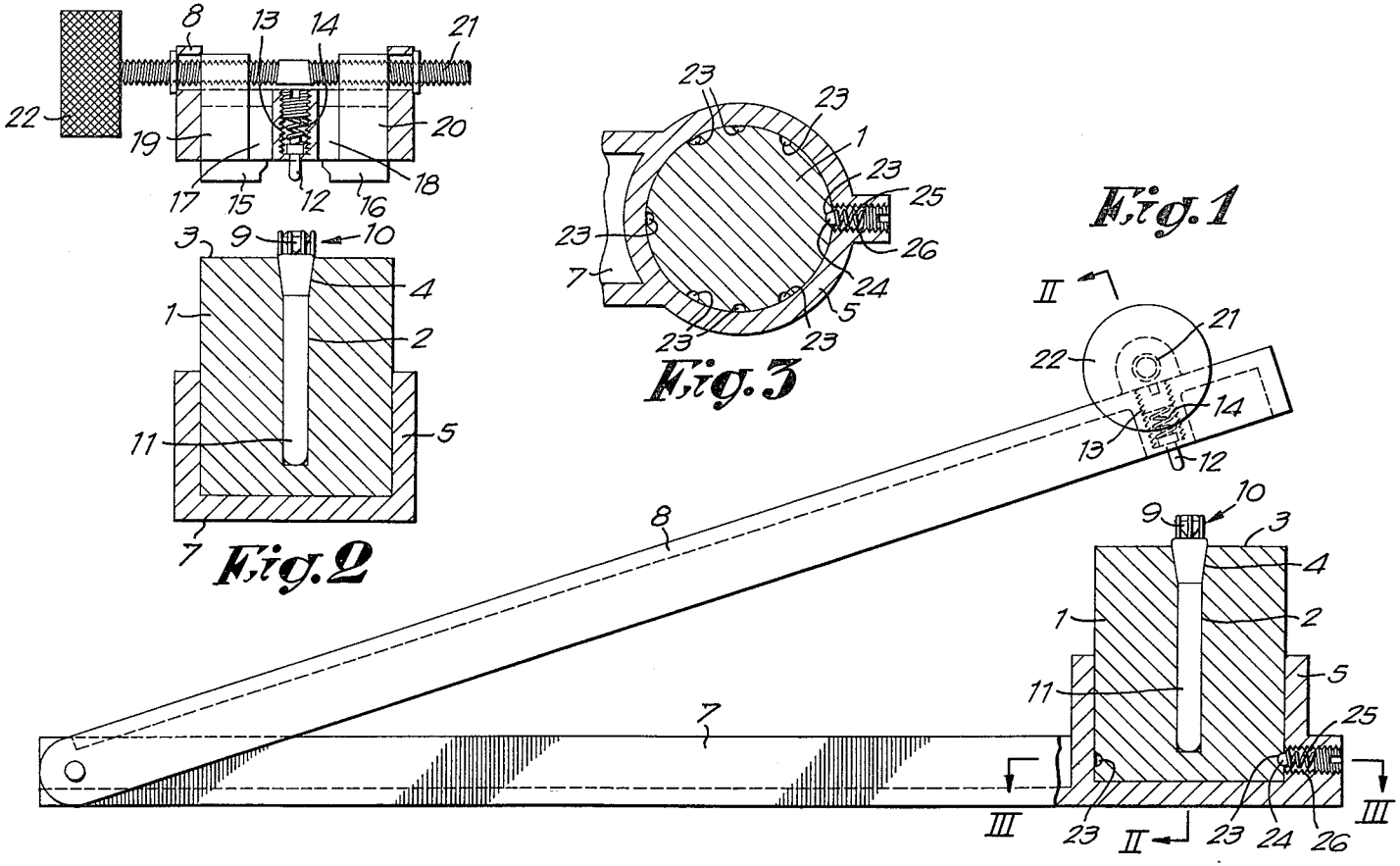
FIG. 1 is a side view, with a partial section, of a device according to the invention.
FIGS. 2 and 3 are sections according to the lines II—II and III—III of FIG. 1.
Figure 4:
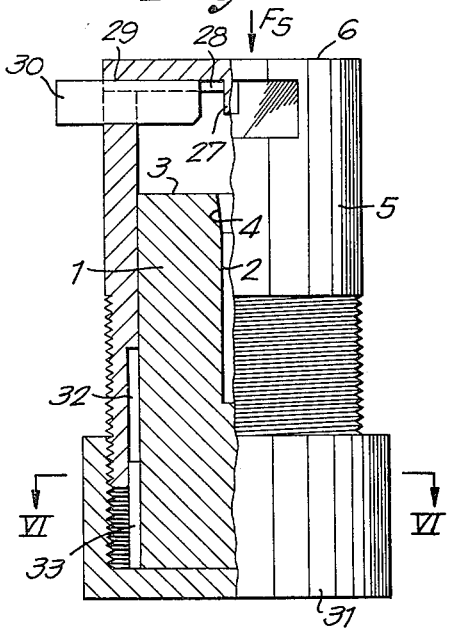
FIG. 4 is a view in elevation and half a vertical section of another device according to the invention.

In the embodiment shown in FIGS. 1–3, a device according to the invention comprises a means for supporting a ring, for instance consisting in a cylindrical body 1, provided with a diametral slot 2 extending from its upper face 3, the latter being possibly provided in its centre with a conical cavity 4.

The depth of the slot 2 is at least equal to the diameter of the largest of the rings which are usually used, whereas its width is approximately equal to the thickness of a ring.

The body 1 is intended for being inserted into a tubular component 5 with a closed bottom 6. The tubular component 5 is carried at an end of an arm 7 on the other end of which is pivotably mounted a lever 8, which is a part of a means for maintaining a stone 9 placed in a bezel 10 of a ring 11 inserted into the slot 2 of the body 1. The maintaining of the stone 9, properly speaking, is ensured by a finger 12, which is axially movable in a tubular guide 13 carried by the lever 8. A spring 14 pushes the finger 12 outside the guide 13.

Two setting blades, which are movable and coplanar, respectively 15 and 16, placed on two opposite sides of the finger 12, are guided in two grooves 17 and 18 provided for this purpose in the lever 8. These blades are each carried by a small block, respectively 19 and 20. These blocks have each a threaded bore, one of which is right-hand threaded and the other left-hand threaded. These bores are crossed by a rod 21 which is right-hand threaded on one section and left-hand threaded on another. This rod 21 also crosses the lever 8 and is provided with a control knob 22.

The body 1 has, on its cylindrical face and adjacent to its base, a series of notches 23 (FIG. 3) intended for cooperating with a ball 24 pushed by a spring 25 mounted in a corresponding housing 26 of the component 5. This arrangement allows one to correctly position the body 1 and, consequently, the ring it carries, in relation to the working plane of the blades 15 and 16.

The height of the body 1 is selected as dependent of two parameters, that is to say the number of the ring (inside diameter) and the size of the stone which is to be set, in such a way that the tops of the claws of the bezel 10 are located at a predetermined distance from the bottom 6. In practice, the user of a device will have ordered a ring and specified the two aforesaid parameters pertaining to his case and this ring will be delivered to him in a body 1 having an appropriate height.

For setting a stone 9 with the device described hereinabove, one places the body 1 carrying a ring in the tubular component 5 so that the ball 24 engages an appropriate notch 23 and one places the stone 9 into the bezel 10. Then, one brings down the lever 8 as far as possible. The finger 12 thus comes into contact with the table of the stone 9 and, due to the action of the spring 14 which is now compressed, firmly maintains the stone. Then one operates the knob 22 in the appropriate direction, which results in the blades 15 and 16 drawing nearer to one another and appropriately bending over two opposite claws of the bezel 10. After this, one draws the blades 15 and 16 away from one another, one lifts the lever 8 and makes the body 1 pivot with an appropriate angle. The aforesaid operations are repeated to obtain the bending over of another pair of claws and so on, as necessary.

In the embodiments of the FIGS. 4 through 8, the body 1 is inserted into the tubular component 5, with its groove 2 directed towards the bottom 6 of the tubular component. This bottom has a central stud 27 the section of which is slightly smaller than the section of the table of the smallest of the stones for which the device is designed, for instance 0.5 crt.

The bottom 6 comprises a radial groove 28 being prolonged by a window 29 in the cylindrical wall of the component 5, in order to guide a setting blade 30 the length of which is greater than the radius of the bottom 6.

The external lower part of the component 5 is threaded for receiving the corresponding part of a lamping sleeve 31. This lower part is also provided with eight grooves 32, for receiving, each, a rib 33 provided for that purpose on the body 1. This arrangement allows to fix the respective angular positions of the slot 2 in relation to the blade 30. The eight grooves 32 are angularly arranged so as to allow the precise setting of rings with four or six claws.

This device functions as follows:

The body 1 being extracted from the component 5, one inserts the chosen ring into the slot 2, until the base of the bezel enters the conical cavity or, possibly, comes to rest on the surface 3.

The stone 9 that is to be set (FIG. 8), more often than never a diamond cut as a brilliant, is then placed between the claws of the bezel 10. The body 1 is then inserted into the component 5, whilst one brings the rib 33 in a groove 32 which is selected so that one of the claws of the bezel 10 will face the blade 30.

Then, one fully screws the sleeve 31, so that the table of the stone 9 becomes firmly pressed against the stud 27. It suffices now to drive the blade 30 with a hammer to attain a correct bending over of the corresponding claw.

One starts the aforesaid operations over again for each of the other claws.

Figure 7:
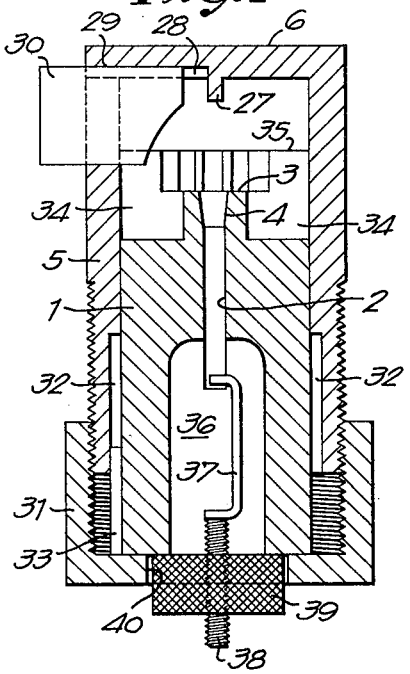
FIG. 7 is an axial section of a variant of the embodiment according to FIG. 5.
Figure 5:
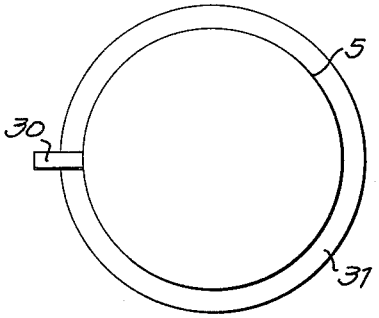
FIG. 5 is a view according to arrow F5 of FIG. 4.
Figure 8:
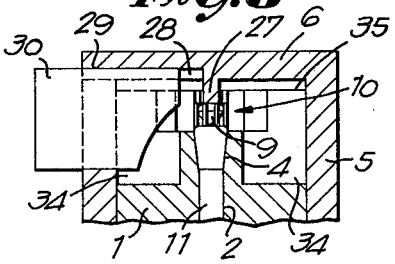
FIG. 8 is a view of the upper part of the device shown in FIG. 7, in another characteristic position.
Figure 6:
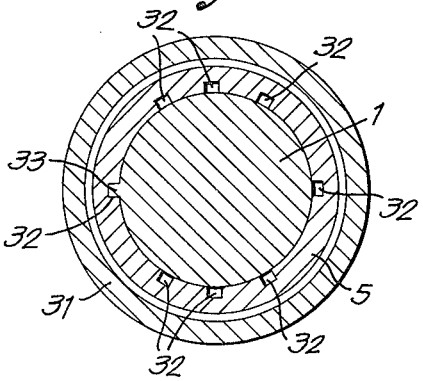
FIG. 6 is a section according to line VI—VI of FIG. 4.

The embodiment variant of the FIGS. 7 and 8 provides radial grooves 34 in a peripheric flange 35, projecting over the face 3 of the body 1. These grooves 34 correspond in number to the grooves 28 and allow, with the latter, to ensure a better guiding of the blade 30 when setting.

In order better to maintain the ring 11, the body 1 has a blind bore 36 in which it is possible to insert a hook 37 for engaging the ring 11. This hook has a threaded shank 38 cooperating with a clamping nut 39. In this case the sleeve 31 has a central bore 40.

It should be noted that the devices according to FIGS. 4 through 8 allow, using one and the same body 1, to mount stones of all dimensions (practically from 0.4 crt onwards) on rings of any number.

In the now preferred embodiment, shown in FIGS. 10–13, the device comprises a base 42 to which is fixed a standard 43. Base 42 is provided with a bore 44 intended to receive the cylindrical shank 45 of a positionning tabel 46. Said shank 45 is provided with a series of notches 47 regularly distributed alongst its periphery and each capable of receiving the extremity of a set screw 48 carried by the base 42.

A further set of notches cooperating with a ball is preferably provided, similar to notches 23 and ball 24 of FIG. 3.

On the upper, forked end of standard 43 is pivoted an arm 49 in the free extremity of which may axially slide a maintaining rod 50 which may be held in the desired position by means of a set screw 51. Arm 49 may be swung from a low position, wherein said rod 50 is coaxial with bore 44, into a high position (shown in dots and dashes on FIG. 10). A tightening screw 52 allows to lock arm 49 in the desired position by drawing together the prongs of the forked end of standard 43.

Standard 43 carries a pair of mutually opposed setting levers 53, 54 respectively. Each of these levers is provided with a lateral, semi-cylindrical protrusion 55 inserted into a correspondingly shaped notch provided into standard 43. The curved ends 56 and 57 respectively of levers 53 and 54 are profiled to form setting jaws, substantially symetrically disposed with respect to the axis of bore 44. Opening and closing of said jaws is obtained by the cooperation of bolt 58 and nut 59 on the one hand, and traction string 60 on the other.

Table 46 and its shank 45 have an axial bore 61 intended to receive the cylindrical tail 62 of a ring carrier 63.

A groove 64 in tail 61 and a set screw 65 carried by table 46 allow to forbid any relative angular displacement of the ring carrier with respect to said table.

The ring carrier 63 has a generally prismatic shape and has a transversal V-shaped cut-out 66 each flank of which showing a groove 67 intended to receive a corresponding part of a ring 11. The latter is further maintained by a clip 68, the profiled extremities of which being inserted in grooves 70 of the ring-carrier 63. This clip has a central cut-out allowing the passage of the upper part of the ring with its bezel.

The operation of the above-described device is as follows.

Arm 49 and rod 50 are brought into high position and nut 59 is turned to open jaws 56, 57 if the device was not already in this position.

Tail 62 of ring-carrier 63, carrying a ring, is then inserted into bore 61 and locked into such a position, by means of screw 65, that the upper parts of the claws of bezel 10 are located between the jaws 56, 57.

The stone to be set is placed in the bezel and the arm 49 is lowered and locked by means of screw 52. Rod 50 is lowered so that its lower end is firmly applied against the table of the stone, then locked by means of screw 51. The stone is now firmly maintained in the bezel. It is now sufficient to successively bend two opposite pairs of claws of bezel 10 by operating screws 59 and 48, each time after having rotated the positionning table 46 an appropriate angle, which is facilitated by guide marks provided to that effect on said table and on base 42.

In order to make the use of the device according to the invention easier, one will preferably select rings having claws that are less strong in the bending area, as shown at 41 in FIG. 9.

It goes without saying that many changes can be made to the embodiments described hereinabove without going outside the scope of the present invention.

The invention also extends to a new industrial product consisting in a cylindrical body with a diametral groove, constituting a ring presenter and intended for being used with a setting device according to the invention.

What I claim is:

1. Device for setting precious stones in bezels with claws mounted on rings or the like, said device including:

a receptacle means;

a support for said ring or the like, said support being at least partially engageable in said receptacle means;

a means for maintaining in position a stone placed in said bezel; and a setting means for setting said claws of said bezel after a stone has been placed therein, said setting means including two angularly displaceable levers mounted on a standard and carrying at one end a setting jaw, control means being provided to move said jaws towards and away from each other.

2. Device according to claim 1, characterized in that said receptacle means is a tubular component carried at one end of an arm on the other end of which is hinged a lever carrying said maintaining means as well as said setting means.

3. Device according to claim 2, characterized in that the said maintaining means is a finger mounted at the end of a spring fixed to said lever.

4. Device according to claim 2, characterized in that said setting means comprises two coplanar setting blades, a common control device being provided for drawing said blades from and to one another.

5. Device according to claim 1, characterized in that said receptacle means is a tube having one closed end, the bottom of which having a central protrusion forming said maintaining means, the ring support being held within said tube by means of a sleeve screwed on said tube, at the open end thereof.

6. Device according to claim 5, characterized in that the setting means comprises at least one setting blade inserted through a slop provided in the cylindrical wall of said tube, in the vicinity of the closed end thereof.

7. Device according to claim 1, characterized in that said ring supporting means is constituted by a cylindrical body having a diametral ring receiving slot extending from one face thereof.

8. Device according to claim 1, wherein said control means include a bolt, carrying an operating nut and traversing said levers between said jaws and said standard, and a spring arranged between said levers and urging said jaws away from each other.

9. Device according to claim 8, wherein said receptacle means is a positioning table having an axial bore intended to receive at least part of said support, said table being rotatably carried by a base and wherein said levers are displaceable in a plane perpendicular to the axis of said standard, said jaws being located above said bore of said positioning table.

10. Device according to claim 8, wherein said receptacle means is a positioning table having an axial bore intended to receive at least part of said support, said table being rotatably carried by a base which supports said base carrying said maintaining means which is constituted by a rod carried by one end of an arm pivoted at its other end on the free extremity of said standard, said rod being axially displaceable and a locking means being provided to lock said rod in any desired position.

11. Device according to claim 1, wherein it comprises an indexing means for locking said support in any one of a plurality of angular positions.

12. Device according to claim 1, wherein said support is constituted by a prismatic body having a transverse V-shaped cut-out the sides of which are each provided with a ring receiving groove, said body having a cylindrical tail insertable into said receptacle means.

13. Device according to claim 12, wherein said prismatic body is provided with a removable clip further maintaining said ring.

* * * * *